US012011079B2

(12) United States Patent
Bundschuh et al.

(10) Patent No.: US 12,011,079 B2
(45) Date of Patent: Jun. 18, 2024

(54) MAGNETIC COSMETICS APPLICATOR

(71) Applicants: GEKA GmbH, Bechhofen (DE); Benefit Cosmetics LLC, San Francisco, CA (US)

(72) Inventors: Ramona Bundschuh, Mönchsroth (DE); Fabian Kurt Schneider, Bruckberg (DE); Sacha Cusseau, New York, NY (US); Viet Huong Bister, Ansbach (DE); Erika Von Jan, Roth (DE); David Monical, Pleasanton, CA (US); Mira Moumene, San Francisco, CA (US)

(73) Assignees: GEKA GmbH, Bechhofen (DE); Benefit Cosmetics LLC, San Francisco, CA (US)

( * ) Notice: Subject to any disclaimer, the term of this patent is extended or adjusted under 35 U.S.C. 154(b) by 206 days.

(21) Appl. No.: 17/420,082

(22) PCT Filed: Jul. 1, 2019

(86) PCT No.: PCT/EP2019/067572

§ 371 (c)(1),
(2) Date: Jun. 30, 2021

(87) PCT Pub. No.: WO2020/141026

PCT Pub. Date: Jul. 9, 2020

(65) Prior Publication Data

US 2022/0061501 A1 Mar. 3, 2022

(30) Foreign Application Priority Data

Dec. 31, 2018 (DE) ..... 102018010013.9

(51) Int. Cl.
*A45D 40/26* (2006.01)
*A46B 9/02* (2006.01)
(Continued)

(52) U.S. Cl.
CPC ..... *A45D 40/262* (2013.01); *A46B 9/021* (2013.01); *A46B 15/0026* (2013.01);
(Continued)

(58) Field of Classification Search
CPC .... A45D 40/00; A45D 40/262; A45D 40/265; A45D 34/042; A45D 34/045;
(Continued)

(56) References Cited

U.S. PATENT DOCUMENTS

2006/0056903 A1 3/2006 Gueret
2011/0284021 A1* 11/2011 Gueret ..... A46B 9/025 132/218
(Continued)

FOREIGN PATENT DOCUMENTS

EP 3466299 A1 4/2019
FR 3015868 A1 7/2015
(Continued)

*Primary Examiner* — Rachel R Steitz

(57) ABSTRACT

A cosmetics applicator made of plastic and having a bristle carrier and having bristles integrally bonded therewith as a single part, whereas the bristle carrier being a permanent magnet while the bristles as such are non-magnetic, characterized in that the bristle carrier comprises a core made of a first plastic filled with magnetic particles and forming an interface at least at the outer circumference thereof, said interface being enclosed by a layer of a second, non-magnetic plastic, wherein the first and the second plastic are preferably welded to each other and the second plastic is preferably harder than the first plastic, and wherein the second plastic is integrally connected to the bristles as a single piece.

18 Claims, 4 Drawing Sheets

(51) Int. Cl.
*A46B 15/00* (2006.01)
*A46D 3/00* (2006.01)

(52) U.S. Cl.
CPC ..... *A46D 3/005* (2013.01); *A45D 2200/20* (2013.01); *A46B 2200/1053* (2013.01)

(58) Field of Classification Search
CPC ..... A45D 2200/20; A46B 9/021; A46B 2200/1053; A46B 3/005; A46B 15/0026
See application file for complete search history.

(56) References Cited

U.S. PATENT DOCUMENTS

| | | | |
|---|---|---|---|
| 2012/0160262 | A1 | 6/2012 | Tranchant et al. |
| 2014/0360521 | A1 | 12/2014 | Caulier et al. |

FOREIGN PATENT DOCUMENTS

| | | | |
|---|---|---|---|
| JP | H09309561 | A | 12/1997 |
| JP | 2000320016 | A | 11/2000 |
| JP | 2005177152 | A | 7/2005 |
| JP | 2017507046 | A | 3/2017 |
| JP | 2017509361 | A | 4/2017 |
| KR | 20160111168 | A | 9/2016 |

* cited by examiner

MAGNETIC COSMETICS APPLICATOR

The invention relates to a cosmetics applicator according to the preamble of the corresponding principal claim and to a method for producing such an applicator according to the preamble of the method claim.

TECHNICAL BACKGROUND

There is a fundamental, practical need for providing cosmetics applicators for applying a paste-like or viscous cosmetic and having a high mass storage capacity and therefore able to cover the entire application, such as complete application of mascara to one entire eyelash arch, without needing to be dipped in the cosmetic reservoir, pulled out of the same, and wiped off again.

Cosmetics applicators comprising a magnetic core have been proposed to solve said problem, in which one or more permanent magnets are integrated for this purpose.

If such an applicator is used together with a cosmetic substance having magnetically attracted particles, such as powdered iron, an increased amount of cosmetic substance can be stored directly at the surface of the core, even when the bristles have been carefully wiped off as may be necessary and can be applied gradually over the course of application. The reason for this is generally that while the wiper does lay down the bristles intensively when wiping and largely removes any substance clinging to the surface thereof, said wiper remains somewhat spaced apart from the root of the bristles and especially from the cylindrical surface of the core, in order to avoid bending and then quickly damaging the bristles when wiping.

However, the previous practice of embedding bar-shaped magnets made of standard materials, for example, and having a certain size in the bristle carrier, is unsatisfactory. This is because the bristle carrier is thereby made completely rigid. The application behavior and thus product acceptance is degraded in general, or at least haptically.

Added to this is the high risk of breakage of such a design when building applicators with a small core diameter, such as mascara applicators.

Also unacceptable is injection-molding the entire applicator core from plastic filled with small, magnetic particles, as has already been tested internally. If a plastic having sufficient elasticity is used for this purpose, such as is needed for forming the bristles, then microcrack formation often occurs at the interface near the surface between the highly flexible, matrix-forming plastic and the entirely rigid small magnetic particles. Said problem is hygienically unacceptable according to current standards.

AN OBJECT OF THE INVENTION

The object of the invention is to provide an applicator having a not excessively rigid magnetic bristle carrier and therefore being much more break-proof in compliance with more stringent hygienic requirements.

The Solution According to the Invention

The solution according to the invention can be provided by the features of claim 1.

A cosmetics applicator made of plastic and having a bristle carrier and bristles integrally bonded therewith as a single part is proposed accordingly. According to the invention, the bristle carrier is a permanent magnet while the bristles as such are non-magnetic. The bristle carrier thereby comprises a core made of a first plastic filled with magnetic particles. The core forms an interface at least at the outer circumference thereof. The interface is enclosed by a layer made of a second, non-magnetic plastic, preferably complete or essentially complete. The first and the second plastic are preferably thereby welded to each other. The second plastic is preferably softer and/or more elastic than the first plastic (as such). The second plastic is integrally connected to the bristles.

A bristle carrier having a magnetic core is produced in this manner. The core is typically a permanent magnet and attracts the cosmetic or mascara substance filled with magnetically attracted particles (referred to below as the cosmetic substance), so that said substance adheres increasingly in the root of the bristles and is not 100% wiped away even when passing through the wiper. Rather, the cosmetic substance forms an increased cosmetic reservoir compared with non-magnetic wipers. Said reservoir can be accessed during application as desired in that the area or hair or eyelash to be treated is guided arbitrarily deeper between the bristles, in order to then receive the cosmetic substance held magnetically on the bristle carrier in the region of the root of the bristles.

According to the invention, the contact between the eyelashes and the bristles of the applicator is improved. This is done by pulling the eyelashes wetted by the magnetizable cosmetic mass under the influence of the magnetic field increasingly into the bristle stock and towards the core—if the applicator is magnetized accordingly, which is preferably the case.

Because the core of the bristle carrier is not made of a rigid magnet, but rather of a plurality of permanently magnetic particles, typically over 200 pieces, bonded by an elastic plastic, the core has an inherent flexibility in such a way that the breaking of its core is prevented. This often also improves the—at least the haptic—application behaviour of the core.

At the same time, the bristle carrier is hygienically faultless. Microcracks present between the magnetic particles and the plastic material bonding the same and expanding during repeated flexing of the bristle carrier are not a problem. This is because the core of the bristle carrier having the magnetic particles is enclosed by the second plastic, at least over the circumference of the core, and is thereby protected against the cosmetic substance.

If the second plastic is suitably selected relative to the first plastic, the outer tube enclosing the core having the permanently magnetic particles substantially uniformly distributed therein also provides a significant supporting effect.

A Further Object of the Invention

An alternative or further object of the invention relates to particular applications. The object is to provide an applicator having a magnetic bristle carrier not having excessive rigidity and providing increased retention of the cosmetic substance.

A Further Solution According to the Invention

The latter object is achieved according to the invention by the features of claim 2, for which protection is sought both independently of claim 1 and in combination with claim 1.

A cosmetics applicator made of plastic and having a bristle carrier and having bristles integrally bonded therewith as a single part is proposed accordingly. According to the invention, the bristle carrier is a permanent magnet while the bristles as such are at least substantially non-magnetic. The bristle carrier thereby comprises a core made of a first plastic filled with magnetic particles. The core has a tubular shape. The center thereof is filled or lined with a non-magnetic plastic. The bristles are thereby made of the plastic filling or lining of the core. Said bristles are connected thereto as an integral part, in that said bristles pass through the tubular core and an optional coating layer enclosing said core at the outer circumference thereof in the radial direction and protrude radially outward past the same.

An applicator comprising a particularly attractive magnetic field can be produced in this manner, because the magnetic region thereof is in the outer region and extends directly to the surface at which the cosmetic substance is to be retained by means of magnetic retention forces.

Because the core of the bristle carrier is not made of a rigid magnet, but rather of a plurality of hard magnetic particles, typically over 200 pieces, bonded by an elastic plastic, and because the core is not predominantly made of the mixture of plastic and magnetic particles, but rather the mixture of plastic and magnetic particles forms an internally hollow tube optionally filled with a highly flexible plastic, the core retains an inherent flexibility. At least the haptic application behavior is thereby improved.

At the same time, a supporting core is present and can prevent the bristle carrier from being excessively bent. The microcracking problem addressed in conjunction with claim 1 can also thereby be addressed and improved. The supporting core is dimensioned for this purpose such that only such elastic deformations of the bristle carrier occur during the service life of the applicator under proper use that do not (or do not to any substantial extent) lead to the bond between the supporting plastic material and the embedded magnetic particles being overcome and unacceptable microcracks forming.

PREFERRED EMBODIMENT OPTIONS FOR THE INVENTION

The following embodiment options are sensible and applicable for both of the above embodiments of the invention.

It has been found to be particularly advantageous if the core is produced from a highly filled plastic. A highly filled plastic is particularly such a plastic comprising at least 60 percent by weight of magnetic particles, and preferably at least 80 percent by weight. Such a plastic generates magnetic forces equivalent to the attractive forces of an inflexible, single-piece ferrite magnet. Such a highly filled material may indeed tend strongly to form microcracks under certain conditions. However, according to the invention, this is compensated for, if an outer protective tube or an outer, typically film-like protective layer made of a plastic not filled with magnetic particles is provided on the circumference.

The magnetic particles are ideally positioned in an aligned manner within the core. Said particles form a magnetic field established during injection molding, prior to hardening of the plastic material. In this manner, the particles can then subsequently form a special magnetic field precisely meeting the current requirements after having become magnetic themselves in the next step by applying a correspondingly strong, formative magnetic field.

It is particularly advantageous if the core comprises a plurality of poles, each made up of a group, that is, a plurality of magnetic particles separated from each other and embedded in the plastic material. For example, it may be reasonable to magnetize the group of innumerable magnetic particles after the final embedding thereof in the plastic material, so that said particles from 2 to 6, better 3 to 6 south poles and 2 to 6, better 3 to 6 north poles, for example. Depending on the type of magnetic particles present in the cosmetic substance, regions of the bristle carrier can be produced at which more cosmetic substance is stored and other regions at which less cosmetic substance is stored.

Ideally, the core comprises at least two different pole sections having a large outer diameter and connected to each other by means of a connecting section having a small outer diameter. Said pole sections are each connected to the remainder of the applicator at the end faces thereof facing away from each other, also by means of a connecting section having a smaller outer diameter. In this manner, more and less intensive magnetic regions can be applied to the bristle carrier.

It is particularly preferable if the core has a hollow cylindrical shape and the center thereof is filled or lined with a second or third non-magnetic plastic. The core to be filled with the second or third plastic can provide a supporting effect for the outer region, said outer region being magnetic because the first plastic and the magnetic particles are mixed there, and can stabilize the outer region of the first plastic having the magnetic particles. In this manner, the core and thus the entire bristle carrier remains flexible. The haptic application properties are thereby improved. The support effect of the core or the inner liner can also, however, prevent the core or the bristle carrier from being overloaded in normal use and forming microcracks or even fracturing entirely.

A second or third plastic can optionally be provided on the outer circumference and enclose the first plastic and the magnetic particles on the circumference in the manner of a tube or a film and thus sealing the same. The inner liner or filling is then also made of said second plastic or of another plastic, namely a third plastic.

It is particularly advantageous if the bristles are made of the second or third plastic forming the center or liner of the magnetic region. The bristles are then connected as an integral part to the center of the magnetic region or the plastic lining or filling the same. To this end, said bristles penetrate the magnetic region and an optional tube-like or film-like coating layer enclosing the outer circumference thereof.

The region made of the first plastic and the magnetic particles mixed with the same ideally comprises recesses or slots or grooves for positively anchoring a second or further plastic molded onto the outer circumference of the first plastic.

Further potential embodiments, effects and advantages according to the invention, or variants of the invention arise from the following description of concrete embodiment examples based on the figures.

LIST OF FIGURES

Figure 2:
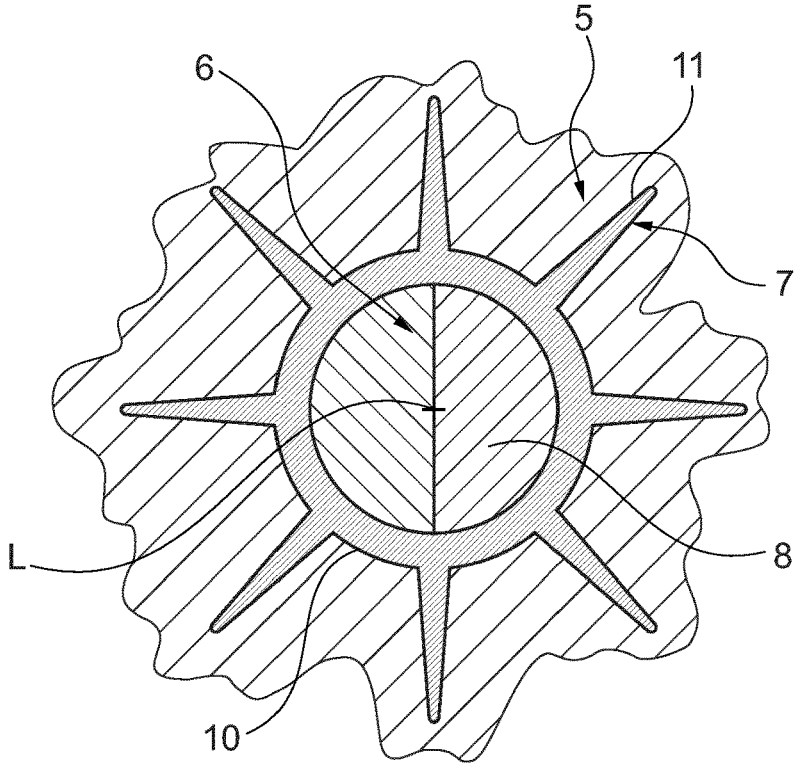
FIG. 2 shows the production process of the applicator shown in FIG. 1.
Figure 2A:
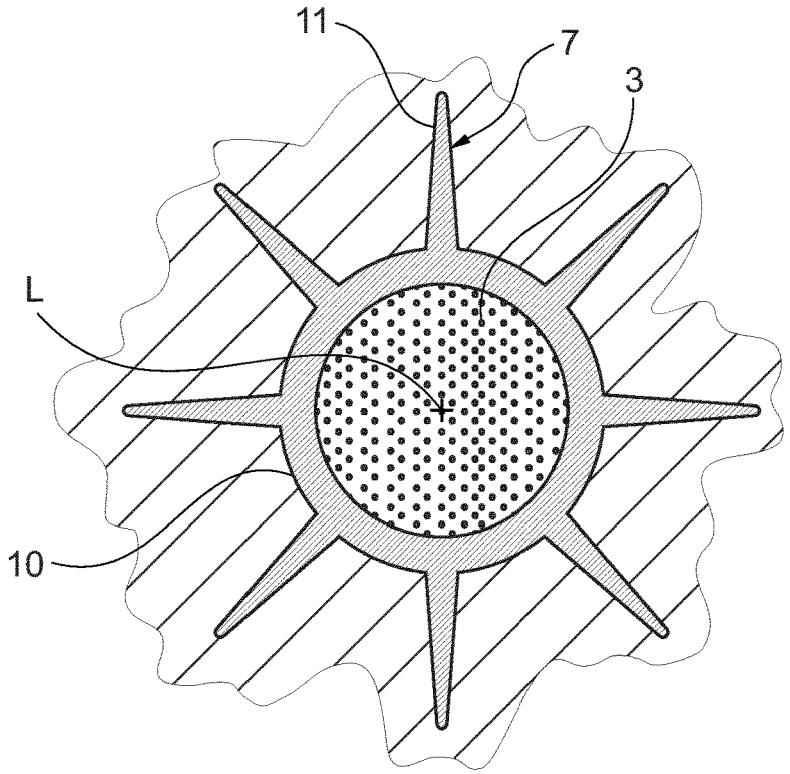

FIG. 2*a* shows the production process according to FIG. 2 after pulling the core and injecting the plastic material comprising magnetic particles.

Figure 1:
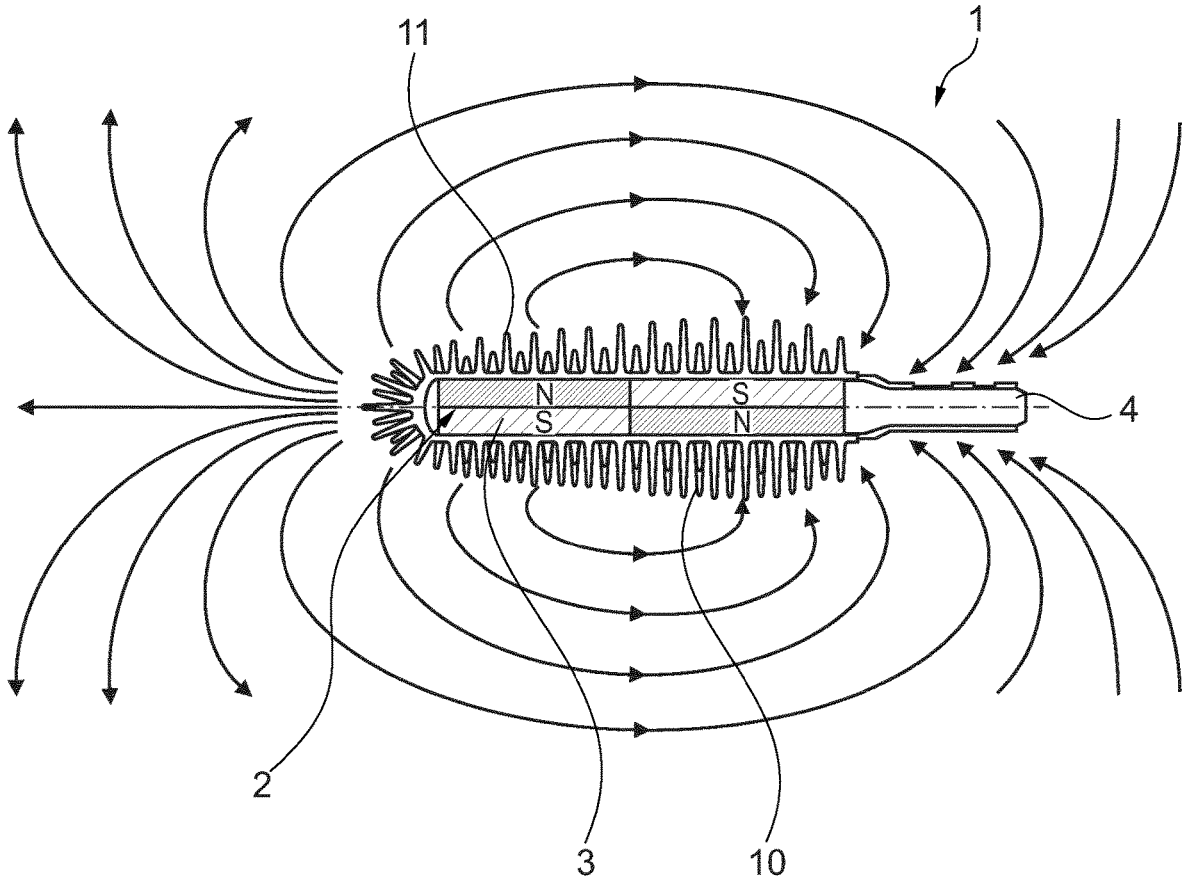
FIG. 1 shows a fundamental example of an applicator according to the invention.
Figure 3:
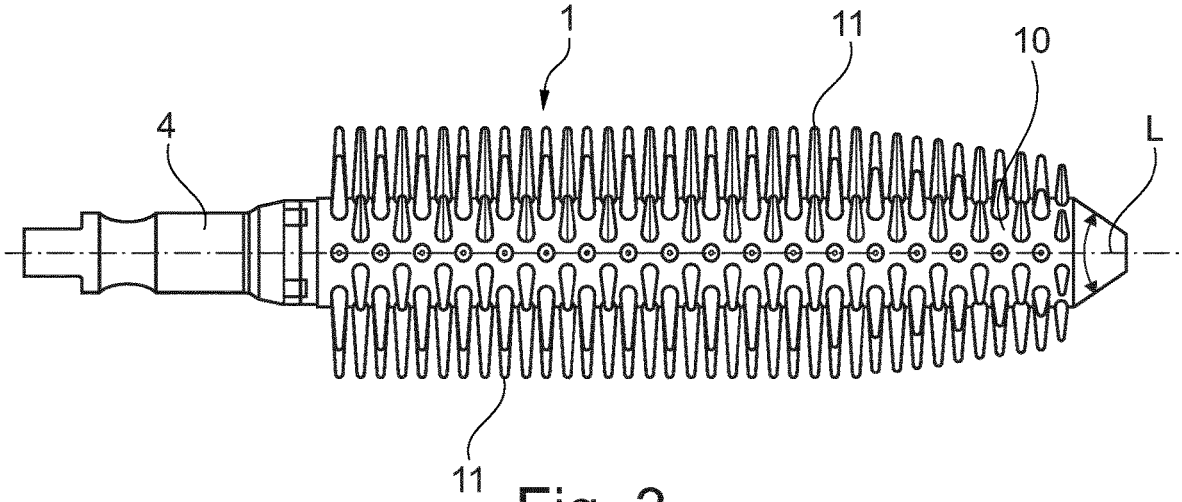

FIG. 3 shows a side view of an applicator according to FIG. 1.

Figure 4:
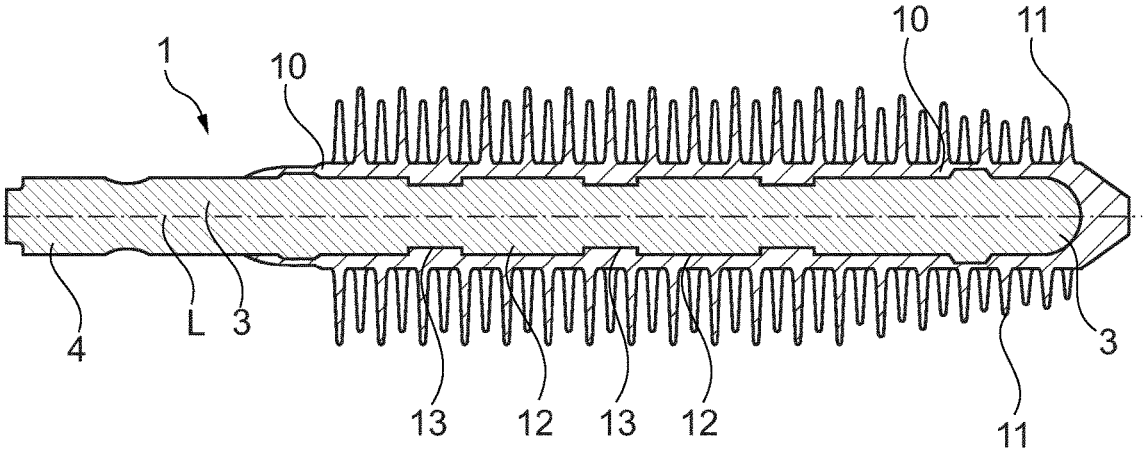

FIG. 4 shows a center longitudinal section of the applicator according to FIG. 3.

Figure 5:
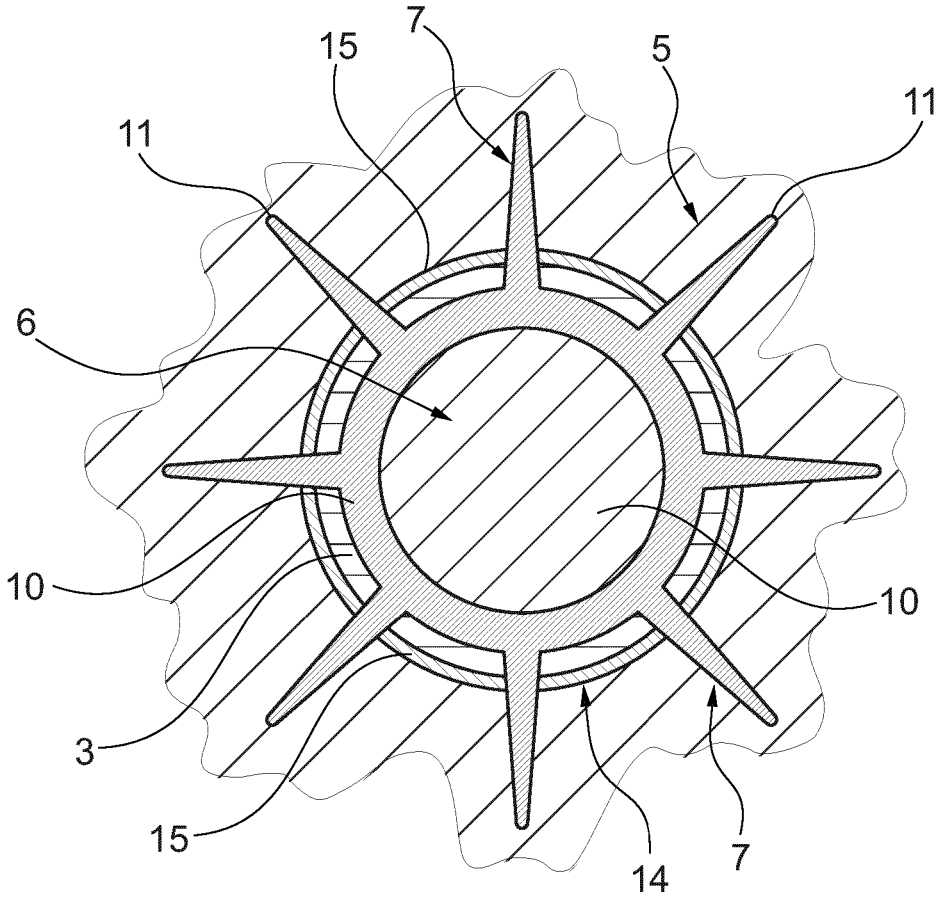

FIG. 5 shows the production process of an alternative applicator wherein the magnetic core 3 is at the outside.

EMBODIMENT EXAMPLES

Example 1

FIG. 1 provides a good overview of the invention, showing a general example of the applicator 1 according to the invention.

As is evident, the applicator 1 comprises a bristle carrier 2. The bristle carrier 2 is made of a magnetic core 3. The magnetic core 3 in turn is made of a first plastic material filled with over 100 hard magnetic particles embedded in said first plastic material. The exterior of the magnetic core 3, preferably also the exposed end face thereof, by a second plastic material 10. The second plastic material is preferably a thermoplastic elastomer, that is, a TPE. Said second plastic material 10 is typically welded or at least laminarly glued to the first plastic material. On this basis, the bristle carrier can be said to be produced as a single part. Chemically compatible plastic materials are ideally used for this purpose.

The second plastic material 10 typically also forms the bristles 11 integrally as a single piece. This is done as can be seen well in FIG. 1. The bristle carrier 2 further preferably comprises a coupling section 4. The coupling section 4 is ideally produced from the same material as the bristles, cf. FIG. 1. For other applications, it is more favorable if the coupling section 4 is produced from the same material as the magnetic core, cf. FIG. 4.

As can be seen very well here, the hard magnetic particles embedded in the first plastic material have been magnetized so as to locally implement a plurality of different magnetic south poles and north poles. In this manner, a strong magnetic field can be achieved.

Various methods are used for producing such an applicator.

The applicator shown in FIG. 1 is preferably produced, for example, as illustrated in FIG. 2.

The second plastic, shown here in heavy lines, is first injected into a corresponding injection mold 5 comprising a central cavity 6 for the bristle carrier and a plurality of cavities 7 emerging therefrom for molding the bristles. A mold core 8 is preferably used thereby and initially keeps the central region of the bristle carrier 2 free of material. In this manner, a typically dense, tubular shape is initially injection molded, from which the bristles extend integrally as a single material.

The core is then withdrawn, if said core has not remained free in any case even without the use of a mold core, as only a reduced quantity of plastic material has been injected. The cavity remaining in the central region is then injected with the first plastic, said plastic being filled with the magnetic particles 9 and embedding and retaining the magnetic particles, cf. FIG. 2. During injecting, the magnetic particles are preferably still non-magnetized, in order to avoid clumping or irregularities due to the magnetic fields.

Preferably, the production process is carried out in such a way that the later magnetic particles are mixed in a non-magnetised state with the "supporting" plastic material and then injected into the mould.

A magnetic field is already applied during or—better—immediately after the injection and before the immobilisation of the magnetic particles by solidification of the plastic carrying them. It is used to align the preferably needle-shaped magnetic particles in the plastic carrying them. The magnetic field is usually adjusted and/or applied at such a late stage that the magnetic particles can align themselves within the plastic material, but are not completely delocalized and separate or agglomerate.

The magnetic particles are often subsequently exposed to a magnetic field that demagnetizes them completely or essentially completely. This ensures that the applicators can be transported or processed in bulk without hindrance, without being magnetically attached to each other and difficult to separate.

The applicators are then, usually after further processing or assembly and fastening in the applicator handle, exposed to a magnetic field again. This magnetic field is so strong that it induces the hard magnetic particles to permanent magnetism in the desired form, i.e. with the field line progression determining the application properties.

The appearance of the applicator in the finished state produced in this manner is shown is FIGS. 3 and 4. The core 3 made of the first plastic and the second plastic 10 of the bristle carrier 2 fully enclosing the same are easily seen here. It is also easily seen, particularly in FIG. 4, that the bristles 11 are integrally connected to the tubular sleeve enclosing the magnetic core 3 and made of the second plastic 10 as a single piece.

It is noteworthy that the core 3 comprises a plurality of different pole segments 12 here having a large outer diameter. Said pole sections 12 are each connected to each other by means of a connecting section 13 having a smaller outer diameter. It can also be easily seen that each of the pole sections 12 are preferably connected to the remainder of the applicator at the end faces thereof facing away from each other by means of connecting section 13 having a smaller diameter.

As can be seen, the pole sections 12 and the connecting sections 13 can interact and form circumferential slots also leading to improved positive anchoring of the sleeve made of the second plastic on the core made of the first plastic and comprising the magnetic particles.

Example 2

FIG. 5 shows an alternative production method for an applicator according to the invention. In this case, a tubular shape 14 is first produced from the first plastic comprising the magnetic particles and serves here as the magnetic core. Said tubular shape can be additionally clad at the outer circumferential surface thereof by a film-like or a tube-like sealing layer 15 made of a second or third plastic. Said tubular shape 14 is then placed in an injection mold 5 having bristle cavities 7 at the outer circumference thereof. A second plastic material is then injected at high pressure into the high central region of the tubular shape 14 from the inside. Wherever the tubular shape 14 does not make full surface contact with the injection mold, but rather crosses the opening region of a bristle cavity 7, the tubular shape 14 is perforated by the second plastic material, said material then entering the bristle cavity 7 on the other side thereof. In this manner, bristles are produced as an integral single piece with the core made of the second plastic.

The central region indicated by cross-hatching in FIG. 5 can thus be fully injected, or, if using a corresponding mold core, can depict only a tubular cladding.

Further Detail about the Preferred Production Method

The injection-molded magnets according to the invention are typical composite materials arising from the embedding of hard ferrite or rare earth magnetic powder in thermoplastic plastics. The quantity proportions of the magnetic powder determine the magnetic and mechanical properties.

Fill levels preferably vary between 84% and 94% magnetic powder (mass percentage).

Polyamide 6 (PA 6), polyamide 12 (PA 12), and polyphenylene sulfide (PPS) are preferably used as the plastic matrix.

In the production process for the plastic-bonded, injection-molded magnets, the magnetic compound is first produced. To this end, the plastic granulate and the magnetic powder are mixed in a thermal mixer or twin-screw extruder and then extruded and granulated. The next step is the processing of the compound in modified injection molding machines. When injection molding arbitrarily anisotropic magnets, a magnetic field can be additionally applied in the axial, radial, diametric, or multipolar direction during injecting or after the start of hardening while the magnetic particles still have some freedom of motion in the still pliable plastic material, and the preferred direction of the magnetic material can be generated parallel to the specified orientation. Otherwise a magnetic field is applied only after cooling, in order to impart hard magnetic properties, that is, permanent magnetism, to the magnetic particles.

Plastic-bonded, injection-molded magnets are more elastic in comparison with plastic-bonded, pressed magnets. Due to the high degree of filling, however, said magnets do not fully achieve the mechanical properties of engineering plastics.

General Embodiments

Protection is also claimed, independently of and/or together with the previously listed claims, for an applicator according to any one or more of the following paragraphs.

A cosmetics applicator forming an interface at least at the outer circumference thereof, the interface being enclosed by a layer made of a second, non-magnetic plastic, wherein the first and the second plastic are preferably welded to each other and the second plastic is preferably softer respectively more elastic than the first plastic (as such), and the second plastic is integrally connected to the bristles as a single piece.

The cosmetics applicator according to one of the preceding paragraphs, characterized in that the core has a hollow cylindrical shape and the center thereof is filled or lined with a second or third non-magnetic plastic.

The cosmetics applicator according to the preceding paragraphs of the present section, characterized in that the bristles are made of the second or third plastic forming the center of the magnetic region and connected integrally thereto as a single piece, in that said bristles penetrate the magnetic region and an optional coating layer enclosing the outer circumference thereof.

A cosmetics applicator according to the preceding paragraphs of the present section, forming an interface at least at the outer circumference thereof, the interface being enclosed by a layer made of a second, non-magnetic plastic, preferably complete or substantially complete, wherein the first and the second plastic are preferably welded to each other and the second plastic is preferably harder than the first plastic, and the second plastic is integrally connected to the bristles as a single piece.

The cosmetics applicator according to the preceding paragraphs of the present section, characterized in that the core has a hollow cylindrical shape and the center thereof is filled or lined with a second or third non-magnetic plastic.

The cosmetics applicator according to the preceding paragraphs of the present section, characterized in that the bristles are made of the second or third plastic forming the center of the magnetic region and connected integrally thereto as a single piece, in that said bristles penetrate the magnetic region and an optional coating layer enclosing the outer circumference thereof.

The cosmetics applicator according to the preceding paragraphs of the present section, characterized in that the bristle carrier comprises a core made of plastic filled with magnetic particles.

The cosmetic application according to the preceding paragraphs of the present section, characterized in that the core is made of a highly filled plastic comprising a proportion of magnetic particles of at least 70% by weight and preferably at least 80% by weight.

The cosmetics applicator according to the preceding paragraphs of the present section, characterized in that the core is made of a first plastic and forms an interface at least at the outer circumference thereof, the interface being enclosed by a layer made of a second, non-magnetic plastic, wherein the first and the second plastic are preferably welded to each other.

The cosmetics applicator according to the preceding paragraphs of the present section, characterized in that the plastic coating layer is integrally connected to the bristles as a single piece.

The cosmetics applicator according to the preceding paragraphs of the present section, characterized in that the core has a hollow cylindrical shape and the center thereof is filled or lined with a second or third non-magnetic plastic.

The cosmetics applicator according to the preceding paragraphs of the present section, characterized in that the bristles are made of the second or third plastic forming the center of the magnetic region and connected integrally thereto as a single piece, in that said bristles penetrate the magnetic region and an optional coating layer enclosing the outer circumference thereof.

The cosmetics applicator according to the preceding paragraphs of the present section, characterized in that the magnetic core is made of a plastic material, wherein the magnetic particles are pressed in the plastic rather than injected.

The cosmetics applicator, optionally according to the preceding paragraphs of the present section, but also uniquely, characterized in that the magnetic core is made of a first plastic material having the magnetic particles and having been injected into the center region of a second plastic while said second plastic material was still liquid or plasticized, said second plastic having been injected into the mold first in the production process, wherein the second plastic material forms the bristles, said bristles being integrally connected to the tube or the sleeve or the film-like sleeve formed by the second plastic material about the first plastic material having the embedded magnetic particles.

In general it is noted that the term "magnetic particles" should be read preferably throughout as "magnetizable particles," as ferromagnetic particles are preferably used wherein the hard magnetic property thereof can be imparted by applying an external magnetic field only after the applicator has been produced.

REFERENCE LIST

1 Applicator
2 Bristle carrier
3 Magnetic core
4 Coupling section
5 Injection mold
6 Central cavity of the injection mold

7 Bristle cavity of the injection mold
8 Mold core
9 Magnetic particle
10 Second plastic material
11 Bristle
12 Pole section
13 Connecting section
14 Tubular shape
15 Sealing layer
L Center longitudinal axis
S South pole
N North pole

The invention claimed is:

1. A cosmetics applicator made of plastic and comprising:
a bristle carrier; and
a plurality of bristles integrally bonded with the bristle carrier as a single part, wherein the bristle carrier is a permanent magnet while the bristles are non-magnetic, and wherein the bristle carrier comprises a core made of a first plastic filled with magnetic particles and forming an interface at least at an outer circumference of the core, said interface being enclosed by a layer of a second, non-magnetic plastic, wherein the first and the second plastic are welded to each other and the second plastic is harder than the first plastic, and wherein the second plastic is integrally connected to the bristles as a single piece.

2. The cosmetics applicator according to claim 1, wherein the core is made of a highly filled plastic comprising a proportion of magnetic particles of at least 70% by weight.

3. The cosmetics applicator according to claim 1, wherein the magnetic particles within the core are aligned and substantially form a magnetic field applied during injecting and prior to hardening of the plastic material.

4. The cosmetics applicator according to claim 1, wherein the core comprises a plurality of magnetic north poles and south poles, each made of a group of magnetic particles embedded in the plastic material of the core.

5. A method for producing the cosmetics applicator according to claim 1, comprising injecting the second plastic material to form a tube having bristles integrally connected thereto, and then fully or partially injecting a center of the tube with the first plastic material having magnetic or magnetizable particles added thereto.

6. The method according to claim 5, comprising hard-magnetizing the magnetic or magnetizable particles in the first plastic material forming the magnetic core by applying a corresponding external magnetic field only after the applicator has been completely produced.

7. A method for producing the cosmetics applicator according to claim 1, comprising placing a magnet in a mold cavity, wherein the magnet is made of the first plastic material in which magnetic particles are embedded, and injecting a tube made of the second plastic material and having integrally connected bristles about said magnet.

8. The method according to claim 7, comprising hard-magnetizing the magnetic or magnetizable particles in the first plastic material forming the magnetic core by applying a corresponding external magnetic field only after the applicator has been completely produced.

9. A cosmetics applicator made of plastic and comprising:
a bristle carrier; and
a plurality of bristles integrally bonded with the bristle carrier as a single part, wherein the bristle carrier is a permanent magnet while the bristles are non-magnetic, and wherein the bristle carrier comprises a core made of a first plastic filled with magnetic particles, wherein the core has a hollow cylindrical shape and a center of the hollow cylindrical shape is filled or lined with a second or third non-magnetic plastic, wherein said bristles are made of the second or third plastic forming the center of the core and are connected thereto as an integral part, and said bristles pass through the tubular core and an optional coating layer enclosing said core at an outer circumference of the core in a radial direction, and protrude radially outward past the outer circumference.

10. A method for producing the cosmetics applicator according to claim 9, comprising first producing a tube made of the first plastic material in which magnetic particles are embedded, and then fully or partially injecting a center of the tube with the second plastic material having no magnetic or magnetizable particles added thereto and forming bristles penetrating through said tube in a radial direction, wherein the bristles are connected to the plastic material filling or lining the center of the tube.

11. The method according to claim 10, comprising hard-magnetizing the magnetic or magnetizable particles in the first plastic material forming the magnetic core by applying a corresponding external magnetic field only after the applicator has been completely produced.

12. The cosmetics applicator according to claim 9, wherein the core is made of a highly filled plastic comprising a proportion of magnetic particles of at least 70% by weight.

13. The cosmetics applicator according to claim 9, wherein the magnetic particles within the core are aligned and substantially form a magnetic field applied during injecting and prior to hardening of the plastic material.

14. The cosmetics applicator according to claim 9, wherein the core comprises a plurality of magnetic north poles and south poles, each made of a group of magnetic particles embedded in the plastic material of the core.

15. A cosmetics applicator made of plastic and comprising:
a bristle carrier; and
a plurality of bristles integrally bonded with the bristle carrier as a single part, wherein the bristle carrier is a permanent magnet while the bristles are non-magnetic, and wherein the bristle carrier comprises a core made of a first plastic filled with magnetic particles and forming an interface at least at an outer circumference of the core, said interface being enclosed by a layer of a second, non-magnetic plastic, wherein the first and the second plastic are welded to each other and the second plastic is harder than the first plastic, and wherein the second plastic is integrally connected to the bristles as a single piece, wherein the core comprises at least two different pole sections having a large outer diameter and connected to each other by a connecting section having a smaller outer diameter and each connected to a remainder of the applicator at an end face thereof facing away from each other by means of another connecting section having a smaller outer diameter.

16. A cosmetics applicator made of plastic and comprising:
a bristle carrier; and
a plurality of bristles integrally bonded with the bristle carrier as a single part, wherein the bristle carrier is a permanent magnet while the bristles are non-magnetic, and wherein the bristle carrier comprises a core made of a first plastic filled with magnetic particles and forming an interface at least at an outer circumference of the core, said interface being enclosed by a layer of a second, non-magnetic plastic, wherein the first and the second plastic are welded to each other and the second plastic is harder than the first plastic, and wherein the second plastic is integrally connected to the bristles as a single piece, wherein the core comprises a plurality of anchoring recesses or anchoring protrusions spaced apart from each other on a circumferential surface of the core.

17. A cosmetics applicator made of plastic and comprising:

a bristle carrier; and a plurality of bristles integrally bonded with the bristle carrier as a single part, wherein the bristle carrier is a permanent magnet while the bristles are non-magnetic, and wherein the bristle carrier comprises a core made of a first plastic filled with magnetic particles, wherein the core has a hollow cylindrical shape and a center of the hollow cylindrical shape is filled or lined with a second or third non-magnetic plastic, wherein said bristles are made of the second or third plastic forming the center of the core and are connected thereto as an integral part, and said bristles pass through the tubular core and an optional coating layer enclosing said core at an outer circumference of the core in a radial direction, and protrude radially outward past the outer circumference, wherein the core comprises at least two different pole sections having a large outer diameter and connected to each other by a connecting section having a smaller outer diameter and each connected to a remainder of the applicator at an end face thereof facing away from each other by means of another connecting section having a smaller outer diameter.

18. A cosmetics applicator made of plastic and comprising:

a bristle carrier; and a plurality of bristles integrally bonded with the bristle carrier as a single part, wherein the bristle carrier is a permanent magnet while the bristles are non-magnetic, and wherein the bristle carrier comprises a core made of a first plastic filled with magnetic particles, wherein the core has a hollow cylindrical shape and a center of the hollow cylindrical shape is filled or lined with a second or third non-magnetic plastic, wherein said bristles are made of the second or third plastic forming the center of the core and are connected thereto as an integral part, and said bristles pass through the tubular core and an optional coating layer enclosing said core at an outer circumference of the core in a radial direction, and protrude radially outward past the outer circumference, wherein the core comprises a plurality of anchoring recesses or anchoring protrusions spaced apart from each other on a circumferential surface of the core.

* * * * *